United States Patent [19]

Bradshaw et al.

[11] 4,336,628

[45] Jun. 29, 1982

[54] NOZZLE WITH PIVOTED WAND

[75] Inventors: David A. Bradshaw; Joseph F. Oles, both of Canton, Ohio

[73] Assignee: The Hoover Company, North Canton, Ohio

[21] Appl. No.: 156,596

[22] Filed: Jun. 5, 1980

[51] Int. Cl.[3] ..... A47L 9/06

[52] U.S. Cl. ..... 15/415 R

[58] Field of Search ..... 15/415 R, 416, 417, 15/418, 419, 420, 421, 377

[56] References Cited

U.S. PATENT DOCUMENTS

| | | | |
|---|---|---|---|
| 1,020,104 | 3/1912 | Matchette | 15/421 X |
| 1,050,989 | 1/1913 | Niuffer | 15/415 |
| 2,325,739 | 8/1943 | Brock . | |
| 2,516,205 | 7/1950 | Hallock | 15/416 X |
| 2,880,446 | 4/1959 | Muller | 15/418 X |
| 3,942,216 | 3/1976 | Minton | 15/419 X |
| 4,167,801 | 9/1979 | Erbor et al. | 15/377 X |

FOREIGN PATENT DOCUMENTS

| | | | |
|---|---|---|---|
| 4371 | of 1915 | United Kingdom | 15/419 |

*Primary Examiner*—Chris K. Moore

*Attorney, Agent, or Firm*—Gerald H. Kreske; Richardson B. Farley

[57] ABSTRACT

The invention described provides a nozzle that includes a pivoted wand to permit relative movement in a vertical plane between the wand and nozzle during manipulation by the operator. The center for the pivot for the wand is located at floor level. This permits friction generated forces that are imparted to the nozzle to be imposed so as to prevent unbalanced moments being generated tending to tip the nozzle during its movement over a floor or carpeting.

6 Claims, 5 Drawing Figures

NOZZLE WITH PIVOTED WAND

BACKGROUND OF THE INVENTION

1. Field of the Invention

This invention relates to floor care appliances and, more particularly, relates to a pivoted wand and nozzle body utilized for the cleaning of floors or the like.

2. Description of the Prior Art

Nozzles with pivoted wands are generally old in the art. These take many forms but include, essentially, a means for pivoting the wand to the nozzle so that relative rotational displacement in a vertical plan may take place between the two to permit the operator of the nozzle to push it over the floor or carpet which is being cleaned. In these arrangements, however, no provision is made to prevent tipping of the nozzle during movement of it backwards and forwards as it is utilized to clean the covering on which it is placed.

Therefore, it would be advantageous to provide a wand-nozzle pivot where the pivot location of the nozzle prevented the generation of unbalanced moments on the nozzle body to prevent its tipping during its to-and-fro movement.

Accordingly, it is an object of this invention to provide a pivoting arrangement for a nozzle and wand configuration which has an anti-tip function.

It is a further object of the invention to provide a wand-nozzle pivot arrangement where the pivot is centered on the floor to prevent the generation of an unbalanced moment of forces around the nozzle body.

It is a still further object of the invention to form the pivot in the bottom plate arrangement so as to conveniently locate it close to the floor on which the nozzle is disposed.

It is an even further object of the invention to provide an improved pivot arrangement for a wand-nozzle configuration.

SUMMARY OF THE INVENTION

A floor care appliance is provided in which a nozzle and pivoted wand arrangement are utilized for the cleaning of a floor or the like. The nozzle body includes a pair of downwardly depending arcuate walls which form a portion of the pivot for the wand for its relative motion to the nozzle. The other portion of the pivot for the wand is formed by an arcuate surface on the top side of the bottom plate, with the wand captured between the bottom plate and the nozzle body when the two are assembled so that it may easily pivot backwardly and forwardly as required.

The arcuate surfaces on the nozzle body and the bottom plate conform to a center point which is located generally and substantially at floor level. Thus, the wand pivots around this center and unbalanced friction forces imparted to the nozzle body during its for and aft movement on the floor pass through the center of the nozzle pivot so that no unbalanced forces are created tending to provide a moment which would tip the nozzle. Thus, a nozzle is provided that does not tend to dig in alternately at its front or back as it moves over the floor or floor covering during cleaning.

BRIEF DESCRIPTION OF THE DRAWINGS

Reference may now be had to the accompanying Drawings for better understanding of the invention, both as to its organization and function, with the illustration being of a preferred embodiment, but being only exemplary, and in which.

DETAILED DESCRIPTION OF THE INVENTION

Figure 1:
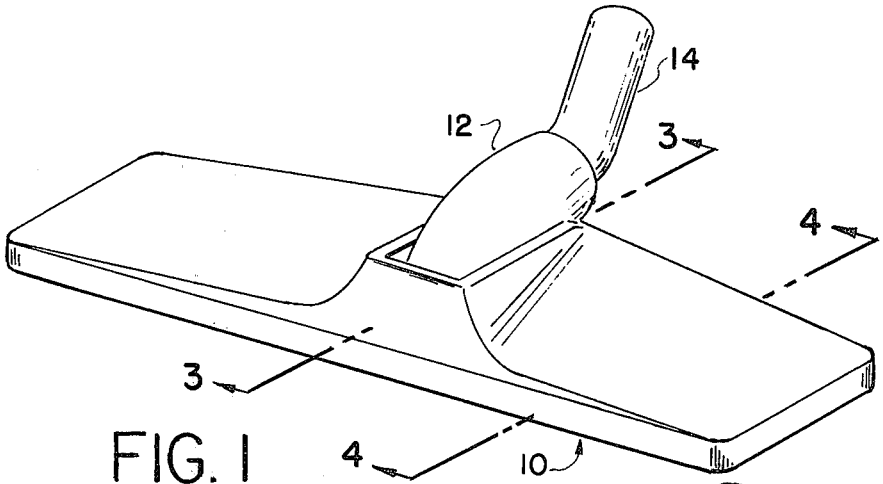
FIG. 1 is a prospective view of a wand and nozzle incorporating the invention.

There is shown in FIG. 1, a nozzle 10, a wand connector assembly 12 and a wand 14 telescopically attached to the wand connector assembly 12. These elements form the general configuration of the inventive pivoted wand-nozzle arrangement utilized in the cleaning function.

Figure 2:
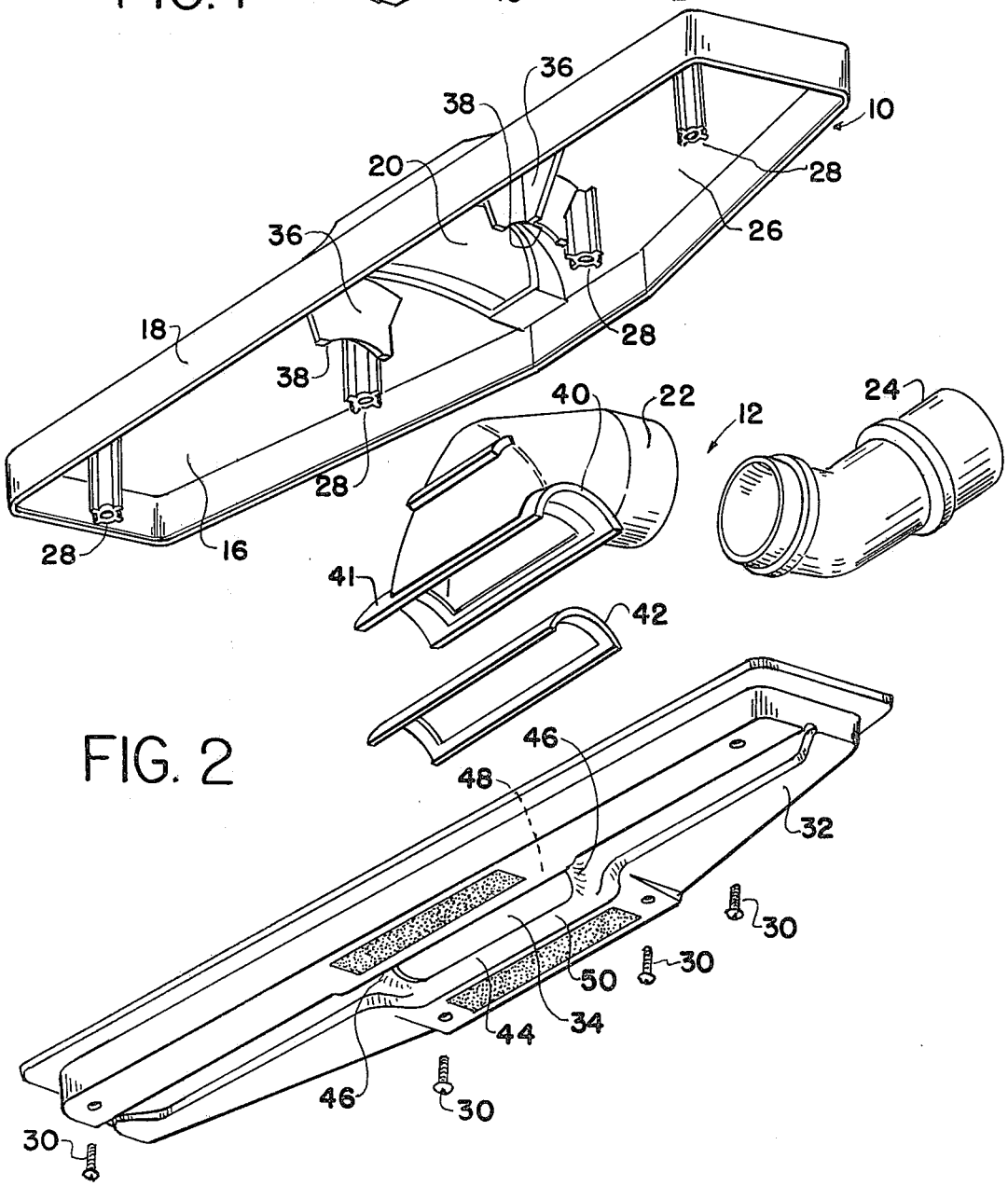
FIG. 2 is an exploded view of the elements which form the invention.
Figure 3:
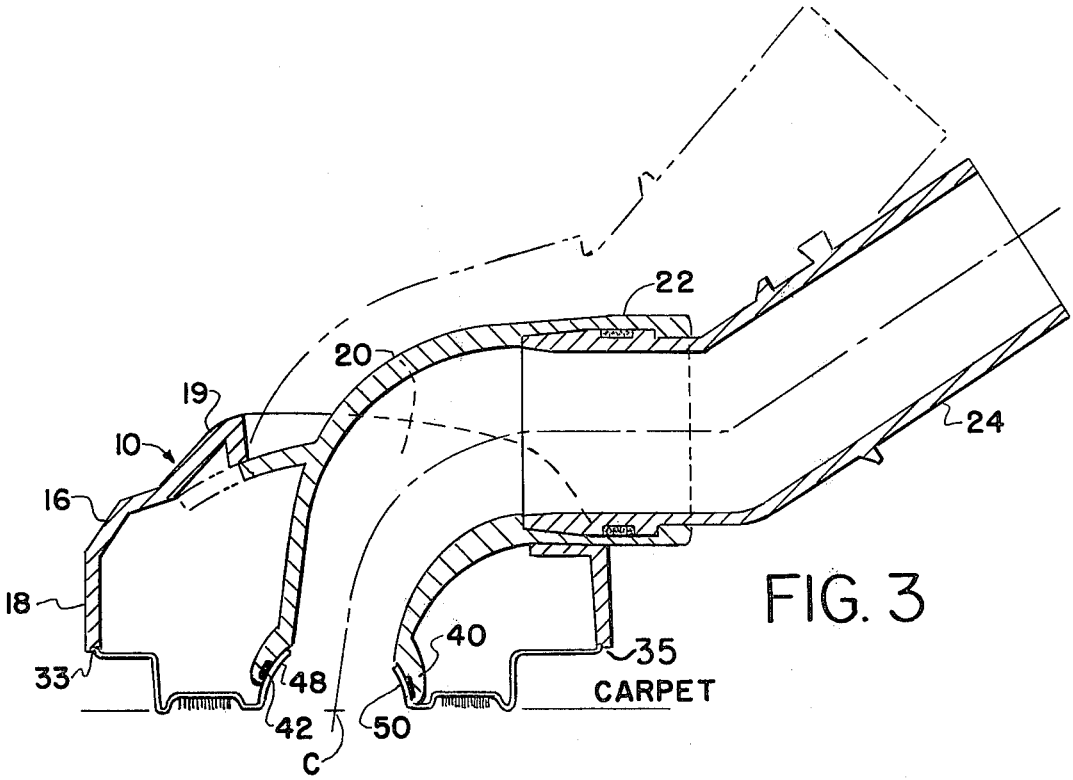
FIG. 3 is a cross sectional view taken on line 3—3 of FIG. 1 and showing the pivot part formed by the bottom plate and the extremes of pivotal motion of the wand piece.
Figure 4:
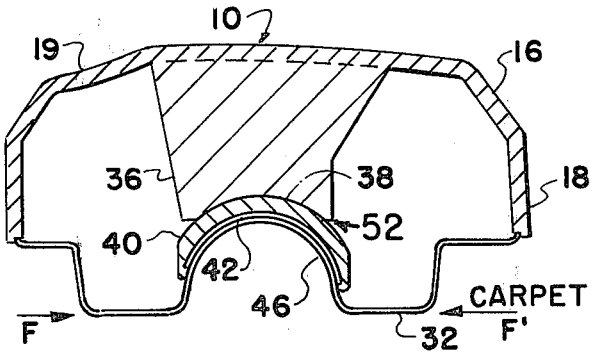
FIG. 4 is a cross sectional view taken on line 4—4 of FIG. 2 showing the formation of the upper pivot part formed by the inner wall of the nozzle body.
Figure 5:
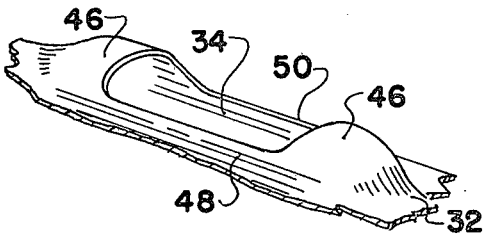
FIG. 5 is a fragmentary top perspective view of the bottom plate.

Referring now to FIG. 2, it can be seen that the nozzle 10 includes a downwardly opening nozzle body 16 having a peripheral, downwardly depending side wall 18 that extends completely around the nozzle body 16. An aperture 20 in a top wall 26 of the nozzle body 16 permits upward assembly of a wand connector assembly piece 22 of the wand connector assembly 12 through the aperture 20 so that, in turn, a wand connector assembly member 24 may be telescopically received in the wand connector assembly piece 22 to thereby form an assembly for connection of the wand 14 upwardly thereof. The aperture 20 is disposed in the top side 19 which is generally crowned in configuration and extends to meet the peripheral side wall 18 at the general lateral extent of the nozzle body 16.

At four convenient locations in nozzle body 16 and fixed and extending down from the top wall 26 of the nozzle body are a series of screw receiving bosses 28, 28, 28, 28 these screw receiving bosses are provided for the reception of screws 30, 30, 30, 30 which mount a bottom plate 32 to nozzle body 16 thereby completing the outer conformation of the nozzle 10. The bottom plate 32 by means of an upturned lip 33, which extends around its periphery, abuts bottom side 35 of nozzle body 16. This provides a generally enclosed housing for the nozzle 10.

Bottom plate 32 includes a centrally located aperture 34 which is utilized to provide suction for the nozzle 10 during the cleaning function, the same communicating with wand 14 through wand connector assembly 12.

The nozzle body 16 includes internal downwardly depending walls 36, 36 which terminate in arcuate surfaces 38,38 which form a trunnion part or cap utilized as a part of the pivot for a pivoted wand attached to the nozzle 10. The wand connector assembly piece 22 includes an arcuate border lip 40 at its bottom which conforms on a top surface 41 to the arcuate surfaces 38,38 to aid in the pivoting function. A seal 42, disposed on the bottom surface of arcuate border lip 40, provides sealing between the bottom plate 32 and the wand connector assembly piece 22.

In order to complete the general pivot arrangement for the wand 14, the bottom plate includes a cylindrical portion 44, located centrally from left to right, extending generally upwardly into the nozzle body 16. This cylindrical portion is located in the area of the aperture 34 so it is intersected and interrupted in its general outline to provide continuous portions 46,46 on the opposite sides of the aperture 34 and curved pieces 48 and 50 in front and in back of the aperture.

It should now be obvious that the wand connector assembly piece 22 is pivotally trapped between the arcuate portions 38,38 of nozzle body 16 and the cylindrical portion 44 of bottom plate 32 so that the arcuate portion 38 of inwardly disposed walls 36 of nozzle body 16, the curved lips 40 of wand connector assembly piece 22 (the seal 42) and the cylindrical portion 44 comprising continuous portions 46,46 and curved pieces 48 and 50 all form a readily usable pivot 52 for the wand 14 as it moves relative to the nozzle 10 during operation by one cleaning floors or carpets. These portions just referred to are all sectionalized parts of right cylinders.

A center C forming this pivot is located exactly at floor level. Thus, frictional forces F and F′ imparted to the nozzle 10 during forward and rearward motion of it over the surface to be cleaned pass through the pivot center C so that no unbalanced moment occurs tending to either tip the nozzle 10 forwardly or aftly. The nozzle, then, smoothly flows over the surface being cleaned with no digging in action.

It should be clear that the objects of the invention set out at the beginning of this description have been fulfilled and that a pivoting arrangement for a nozzle-wand configuration has been provided that substantially eliminates tipping of the nozzle during its operation on the floor or floor covering. In practice, it has been found that the floor centered pivot does not actually have to be exactly at floor level just substantially so, and an actual embodiment carrying out the principles of this invention providing a satisfactory nozzle was arrived at utilizing a pivot that was actually 0.1 inches above floor level. It should also be clear that many modifications may be made to the structure set out which would still fall within the spirit and purview of the invention described.

What is claimed is:

1. A pivoting nozzle and wand arrangement including;

(a) a nozzle body, (b) a bottom plate attached to the bottom of said nozzle body, (c) a floor centered pivot means adjacent said bottom plate extending into said nozzle body for freely pivoting said wand, (d) whereby friction induced forces generated by nozzle movement over a floor pass through said floor centered pivot means to produce substantially no unbalanced moment to the nozzle.

2. A nozzle including;

(a) a nozzle body, (b) a first pivot structure mounted with said nozzle body and non-rotatably fixed relative thereto and having its center located substantially at floor level; and (c) a wand and a second pivot structure non-rotatably fixed relative to said wand and having its center at substantially floor level, said wand being directly pivoted to said nozzle by pivoting cooperation of said first and second pivot structures, (d) whereby friction induced forces generated by nozzle movement over a floor produce substantially no unbalanced moment to the nozzle.

3. A pivoting nozzle and wand arrangement including;

(a) a nozzle body, (b) a bottom plate attached to the bottom of the nozzle body, (c) an arcuately shaped portion formed in said bottom plate, (d) at least one arcuately shaped portion formed in said nozzle body, (e) a wand piece disposed between said arcuately shaped portions and having surfaces cooperating with said nozzle body and bottom plate arcuate shaped portions, (f) said arcuately shaped portions forming conforming surfaces for pivotal reception of said wand piece, (g) said conforming arcuately shaped portions having as their center a pivot point, (h) said pivot point being located at floor level, (i) whereby friction induced forces generated by nozzle movement over a floor produce substantially no unbalanced moment to the nozzle.

4. The pivoting nozzle and wand arrangement of claim 3 wherein;

(a) said arcuately shaped portion formed in said bottom plate is apertured to form a suction opening for said nozzle.

5. The pivoting nozzle and wand arrangement of claim 3 wherein;

(a) a seal is provided for the end of said wand piece, (b) said seal riding on said arcuately shaped portion formed in said bottom plate.

6. The pivoting nozzle and wand arrangement of claim 3 wherein;

(a) said wand piece is hollow for the passage of suction air.

* * * * *